US006689143B2

(12) United States Patent
Cense et al.

(10) Patent No.: US 6,689,143 B2
(45) Date of Patent: Feb. 10, 2004

(54) HAIR REMOVING DEVICE COMPRISING A HEATING MEMBER

(75) Inventors: Abraham Josephus Cense, Eindhoven (NL); Michiel Errit Roersma, Eindhoven (NL); Gerrit Jan Veldhuis, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/078,956

(22) Filed: Feb. 19, 2002

(65) Prior Publication Data

US 2002/0120278 A1 Aug. 29, 2002

(30) Foreign Application Priority Data

Feb. 23, 2001 (EP) ..... 01200668

(51) Int. Cl.[7] ..... A61B 17/41
(52) U.S. Cl. ..... 606/133
(58) Field of Search ..... 606/131, 133, 606/134, 27

(56) References Cited

U.S. PATENT DOCUMENTS 5,065,515 A * 11/1991 Iderosa ..... 30/140
5,704,935 A * 1/1998 Pahl et al. ..... 606/48
5,827,294 A * 10/1998 Mehl, Sr. ..... 606/133
5,849,018 A * 12/1998 Rosson et al. ..... 606/133
6,074,385 A * 6/2000 Klopotek ..... 606/27
6,187,001 B1 * 2/2001 Azar et al. ..... 606/9
6,280,438 B1 * 8/2001 Eckhouse et al. ..... 606/9
6,406,483 B1 * 6/2002 Obermann et al. ..... 606/131
6,416,521 B1 * 7/2002 Waldner et al. ..... 606/133
6,533,775 B1 * 3/2003 Rizoiu ..... 606/9

FOREIGN PATENT DOCUMENTS

EP 0532106 B1 3/1993 ..... A45D/26/00
JP 10-276832 * 10/1998
WO WO0076363 12/2000 ..... A45D/26/00

* cited by examiner

*Primary Examiner*—Ralph A. Lewis

(57) ABSTRACT

The invention relates to a hair removing device (1) comprising a hair removing member (3) for removing hairs from human skin and an auxiliary member for generating a change of the temperature of the skin present near the hair removing member. According to the invention, the auxiliary member comprises a heating member (13) for generating a rise in temperature of the skin present near the hair removing member. Said temperature rise has a pain masking effect, which can be attributed to the fact that the heat receptors present in the heated skin generate heat signals in the nervous system which block the pain signals generated by the adjacent pain receptors when the hairs are being removed. Thus, the user experiences less pain during the removal of the hairs.

Figure 1:
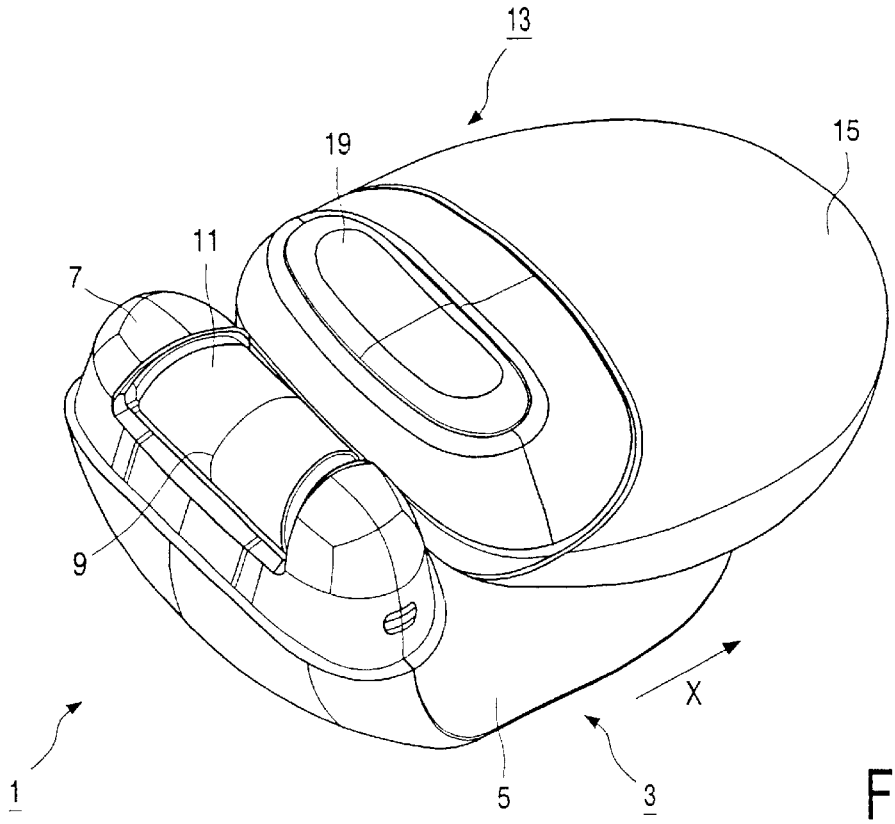

In a preferred embodiment, the heating member (13) comprises a skin contacting element (19) which is in thermal contact with a compound having a eutectic composition contained in a chamber (17) of a holder (15). Examples of such a compound are $CH_3COONa{\cdot}3H_2O$ and $NaOH{\cdot}H_2O$.

15 Claims, 3 Drawing Sheets

HAIR REMOVING DEVICE COMPRISING A HEATING MEMBER

FIELD OF THE INVENTION

The invention relates to a hair removing device comprising a hair removing member for removing hairs from skin, and an auxiliary member for generating a change in temperature of the skin present, during operation, near the hair removing member.

The invention also relates to an auxiliary member which can suitably be used in a hair removing device in accordance with the invention.

BACKGROUND OF THE INVENTION

A hair removing device and an auxiliary member of the types mentioned in the opening paragraphs are known from WO-A-00/76363. The known hair removing device is an epilation device by means of which hairs are mechanically extracted from the skin. The hair removing member of the known hair removing device comprises a series of clamping discs which are rotatably journaled in an epilation head. During rotation of the clamping discs, said clamping discs are tiltable in pairs from a hair catching position, in which hair catching spaces are present between the pairs of clamping discs, to a clamping position in which the pairs of clamping discs are clamped against each other near their edges. Hairs that penetrate said hair catching spaces when the clamping discs are in the hair catching positions are subsequently clamped, in the clamping positions of the clamping discs, between said clamping discs and extracted from the skin under the influence of the rotating movement of the clamping discs.

The auxiliary member used in the known hair removing device is a cooling member which is provided with a skin contact element and a holder which is in thermal contact therewith, in which holder a substance having a comparatively high cold capacity is provided. The cooling member is detachably coupled to a main housing of the hair removing device. Before using the hair removing device, said substance should be cooled to a comparatively low temperature by placing the cooling member, for example, in a refrigerator for some time. If the cooling member is coupled to the main housing, the skin contact element is situated, viewed in a direction wherein the hair removing device is to be displaced over the skin, directly in front of the hair removing member. Consequently, during displacing the hair removing device over the skin, the skin is first cooled by the cooling member and immediately after that treated by the hair removing member. By previously cooling the skin, the pain that is usually felt when hairs are extracted is masked. This masking effect can be attributed to the fact that the pain stimuli generated during extracting the hairs by pain receptors present around the hairs, are only partially passed on via the nervous system because said nervous system is partly blocked to pain stimuli by the cold stimuli already present in the nervous system that are generated by the cold receptors present around the hairs. By virtue of this masking effect, the extraction of hairs is experienced as considerably less painful.

SUMMARY OF THE INVENTION

It is an object of the invention to provide a hair removing device of the type mentioned in the opening paragraph, by means of which said masking effect is enhanced, so that the pain felt during extracting hairs is reduced still further.

To achieve this object, a hair removing device in accordance with the invention is characterized in that the auxiliary member includes a heating member for generating an increase in temperature of the skin present, in operation, near the hair removing member. It has been found that the heat receptors present in the skin generate more heat stimuli per unit of time in a certain range of the skin temperature than the number of cold stimuli that can be maximally generated per unit of time by the cold receptors present in the skin. Said range of the skin temperature lies between approximately 40° C. and 47° C., a maximum number of heat stimuli per unit of time being generated at a skin temperature of approximately 45° C. It is to be noted that the above-mentioned skin temperature values are values at approximately 0.1 mm below the skin surface, i.e. at the location of the heat receptors. It has been found that said larger number of heat stimuli in said range of the skin temperature leads to an increased blocking of the nervous system to the pain stimuli generated by the pain receptors during the extraction of hairs. By increasing the temperature of the skin present near the hair removing member, before extracting the hairs, by means of the heating member to a value in the above-mentioned range, an increased masking effect is achieved by means of the hair removing device in accordance with the invention, as a result of which the pain experienced during the extraction of the hairs is reduced still further.

A particular embodiment of a hair removing device in accordance with the invention is characterized in that the heating member is provided with a holder wherein a compound having a eutectic composition is provided, and a skin contact element which is in thermal contact with said compound. Such a compound crystallizes at a substantially constant temperature, the so-termed eutectic temperature, from the liquid phase to the solid phase. In this particular embodiment, the compound must be converted to the liquid phase by heating before using the hair removing device. During operation of the hair removing device, the compound crystallizes, upon reaching the eutectic temperature, from the liquid phase to the solid phase, which process takes some time as a result of the so-termed latent thermal capacity of the compound. As a result, the skin contact element is kept at a substantially constant temperature for some time, which temperature is determined by the eutectic temperature of the compound. As a result, the temperature of the skin present near the hair removing member is increased for some time by the heating member in a predetermined manner, so that said heating member provides a predetermined, desirable masking effect for some period of time. In this embodiment, the heating member has a simple structure and does not require any electrical power supply during operation of the hair removing device.

A further embodiment of a hair removing device in accordance with the invention is characterized in that the compound comprises $CH_3COONa \cdot 3H_2O$ or $NaOH \cdot H_2O$. The eutectic temperature of said compounds is 58° C. and 61° C., respectively. If the contact with the skin contact element is of short duration, then such temperatures of the skin contact element are not experienced as unpleasant by the user, and, if the size of the skin contact element is sufficient, the skin temperature is raised to the desired value in the range between 40° C. and 47° C. in a comparatively short period of time, enabling the hair removing device to be moved over the skin comparatively rapidly. Said compounds additionally have a comparatively large latent heat capacity, so that the eutectic temperatures are maintained for a comparatively long period of time and the heating member provides the desired masking effect for a relatively long period of time.

Yet another embodiment of a hair removing device in accordance with the invention is characterized in that the heating member comprises a coupling member by means of which the heating member is detachably coupled to a housing of the hair removing device. In this embodiment, before using the hair removing device, the heating member is uncoupled from said housing in order to be heated separate from the housing and the hair removing member. The uncoupled heating member can be heated, for example, in hot water or in an electrical heating apparatus. By virtue thereof, the hair removing device can be used in a very practical way.

A particular embodiment of a hair removing device in accordance with the invention is characterized in that the heating member is provided with a controllable electric resistor, a skin contact element that is in thermal contact with the resistor, and a control member for controlling the temperature of the skin contact element. In this embodiment, the heating member is embodied so as to be comparatively inexpensive, and the heating member operates in a reliable manner. In addition, the desired masking effect is continuously provided by the heating member.

A further embodiment of a hair removing device in accordance with the invention is characterized in that, in operation, the control member causes the skin contact element to be at a substantially constant temperature in the range between approximately 55° C. and 85° C. If the contact with the skin contact element is of short duration, then a temperature of the skin contact element in said range is not experienced as unpleasant by the user. If the size of the skin contact element is sufficient, then, at such a temperature of the skin contact element, in addition, the skin temperature is raised to the desired value in the range between 40° C. and 47° C. in a comparatively short period of time, enabling the hair removing device to be moved over the skin comparatively rapidly.

Yet another embodiment of a hair removing device in accordance with the invention is characterized in that the temperature of the skin contact element ranges, in operation, between approximately 77° C. and 83° C. At a temperature of the skin contact element in said range, the size of the surface of the skin contact element, which is necessary to enable sufficient heat to be transferred from the heating member to the skin, is limited considerably, so that the dimensions of the heating member are also limited considerably.

A particular embodiment of a hair removing device in accordance with the invention is characterized in that the heating member comprises a source of infrared light. In this embodiment, the source of infrared light is situated, in operation, at some distance from the skin. By employing said source, the skin is heated very effectively, so that the skin temperature is raised to the desired value in the range between 40° C. and 47° C. within a very short period of time. In addition, the heating member in this embodiment is embodied so as to be very inexpensive.

BRIEF DESCRIPTON OF THE DRAWINGS

Figure 2:
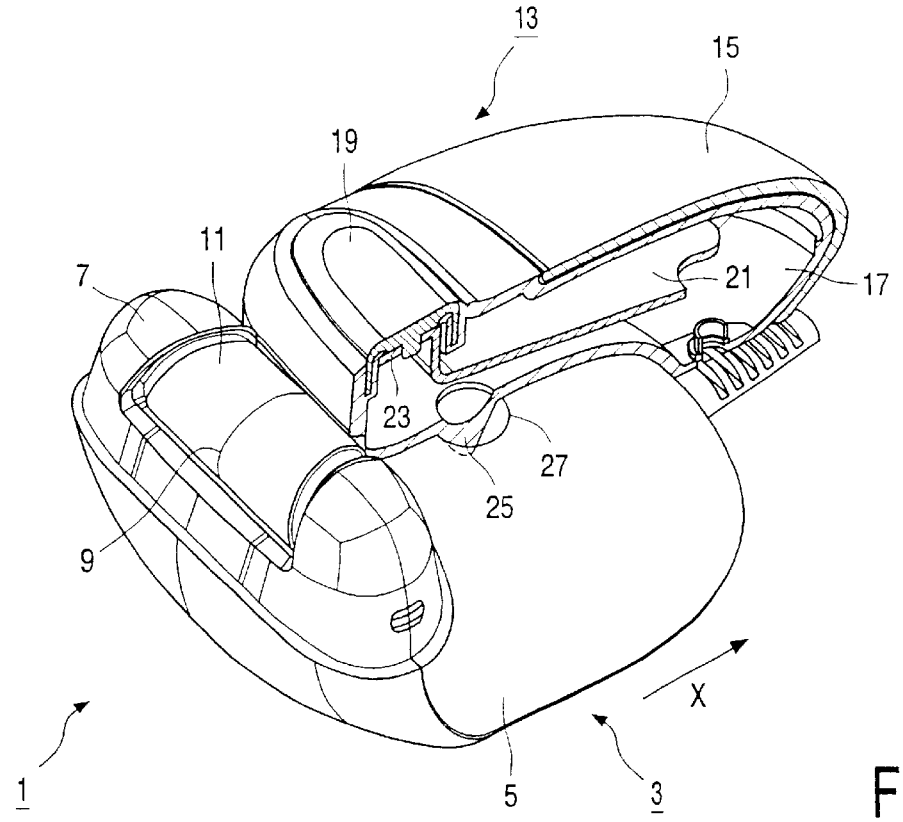
Figure 3:
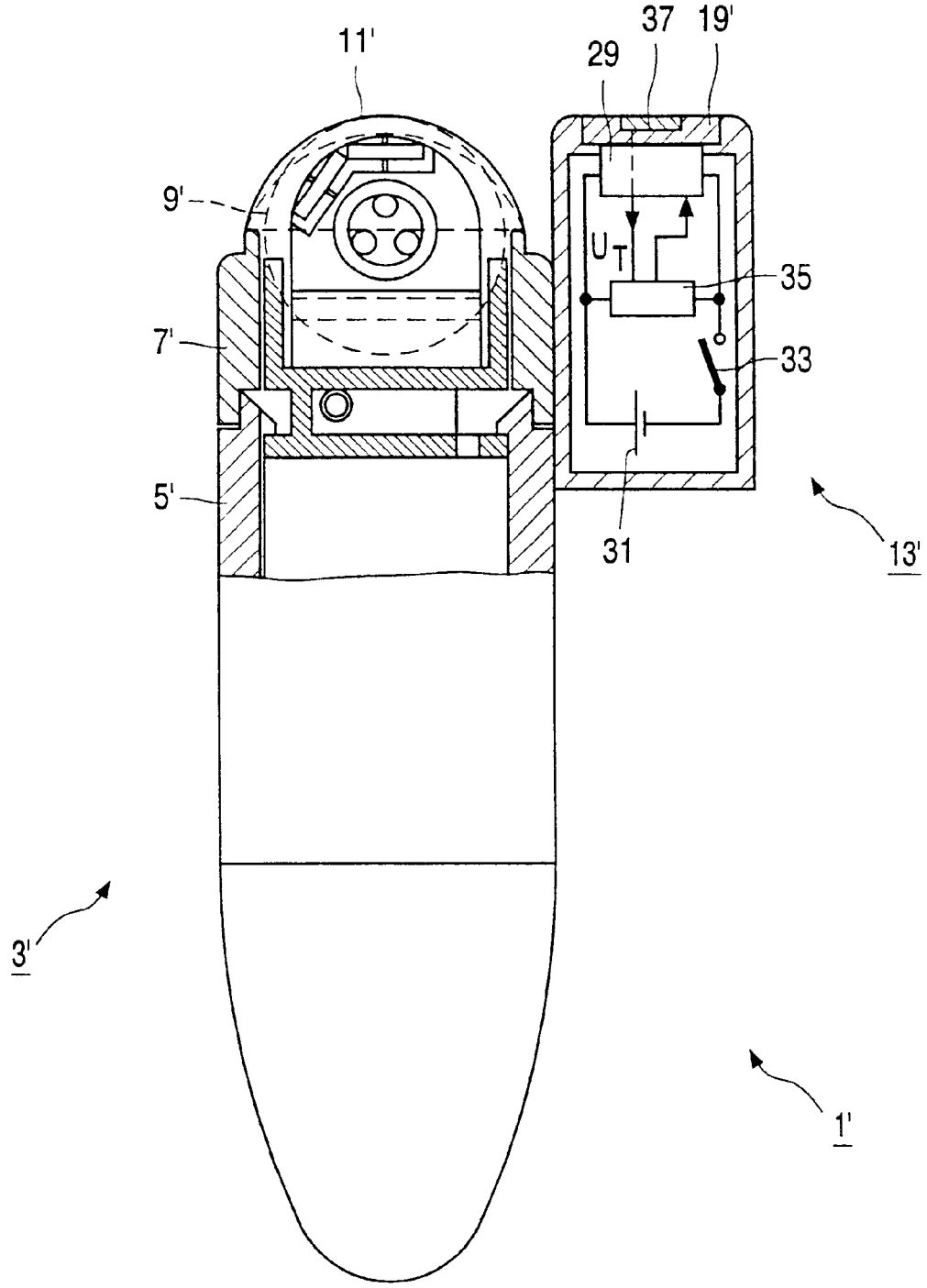
Figure 4:
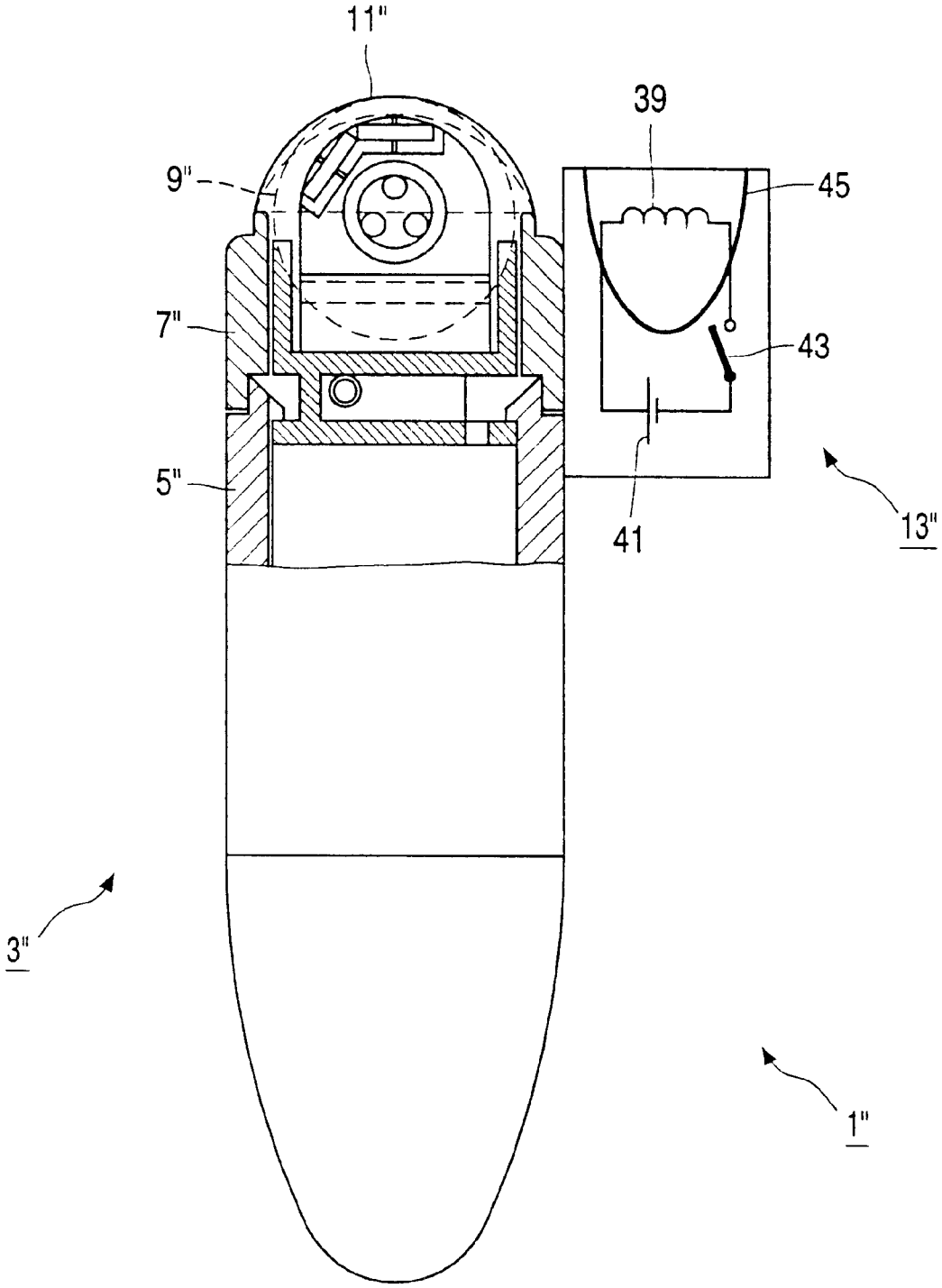

Embodiments of a hair removing device in accordance with the invention will be explained in greater detail hereinafter with reference to the annexed drawing, wherein FIG. 1 shows a first embodiment of a hair removing device in accordance with the invention, FIG. 2 is a partly cross-sectional view of the hair removing device shown in FIG. 1, FIG. 3 is a diagrammatic, sectional view of a second embodiment of a hair removing device in accordance with the invention, and FIG. 4 is a diagrammatic, sectional view of a third embodiment of a hair removing device in accordance with the invention.

DETAILED DESCRIPTION OF THE PREFERRED EMBODIMENT

FIG. 1 and FIG. 2 show a first embodiment of a hair removing device 1 in accordance with the invention, which is provided with a hair removing member 3 for removing hairs from human skin. Said hair removing member 3 comprises a main housing 5 and an epilation head 7 which is detachably secured on said main housing, said epilation head being used to mechanically remove hairs from the skin.

The epilation head 7 comprises, in this example, a series of clamping discs 9, as disclosed in EP-B-0 532 106, which clamping discs are not shown in further detail in FIG. 1 and FIG. 2. A detailed description of the structure and operation of the epilation head 7 is given in said EP-B-0 532 106.

With reference to FIGS. 1 and 2 of EP-B-0 532 106, there is shown a drive shaft for an epilation apparatus with a centerline extending parallel to an epilation opening provided in an epilation head of a housing. The drive shaft is provided with three parallel round metal rods which are arranged in an equilateral triangle seen in a plane perpendicular to the centerline, the point of intersection of the centerline with the plane being situated near the centre of gravity of the triangle (see FIG. 3 of the reference). As is shown in FIG. 2 of the reference, the two ends of each of the three rods are fastened to a first mounting disc which can rotate by means of a journal in a bearing bush of a first bearing support of the housing, and a second mounting disc which can rotate by means of a journal in a bearing bush of a second bearing support of the housing, respectively. The first mounting disc is provided with a toothed rim which is in engagement with a toothed belt. As FIG. 1 of the reference shows, the toothed belt is furthermore in engagement with a gearwheel which is fastened to an output shaft of an electric drive motor arranged in the housing, by means of which the drive shaft can be rotated.

As FIGS. 1 and 2 of the reference show, the epilation apparatus is further provided with a number of pinching discs made preferably of metal which are coupled to the drive shaft so as to rotate along with the latter and are identical except for the two outermost pinching discs. Each pair of adjoining pinching discs is pivotable in a manner about a pivot axis directed transverse to the centerline of the drive shaft into a pinching position in which the two pinching discs of the relevant pair exert a pinching force on one another near the epilation opening. In the position of the drive shaft depicted in FIG. 2 of the reference, a first pair of pinching discs are in the pinching position, whereby hairs clamped between the pinching discs are pulled from the skin exposed to the pinching discs through the epilation opening owing to the rotation of the drive shaft. When the drive shaft rotates further, a second pair of pinching discs and a third pair of pinching discs will enter the pinching position consecutively, upon which the first pair of pinching discs again enter the pinching position after one full revolution of the drive shaft.

FIGS. 4*a* and 4*b* of the reference show a first embodiment of a pinching disc having three oval windows which are arranged around a central, partly spherical hub. It is visible from FIG. 4*b* of the reference that the hub is provided with a projecting step on either side of the pinching disc, while the lateral surfaces of the pivot hub adjoining the windows each form part of a spherical surface whose center coincides with the center of the pinching disc. The hub lies with its lateral surfaces against the three rods of the drive shaft, which rods are depicted in cross-section in FIG. 4*a* of the reference. The other parts of the windows are provided around the rods with clearance. Owing to the use of the spherical hub, the pinching disc is enclosed between the rods in radial directions relative to the centerline substantially without play. During rotation of the drive shaft, at least one of the rods bears on an edge of the relevant window, while a pivoting movement of the pinching disc about a pivot axis transverse to the centerline is rendered possible by the said clearance of the windows around the rods.

The clamping discs 9 of the present invention are rotatably journaled in the epilation head 7 and, during rotation, can be tilted in pairs from a hair catching position, in which hair catching spaces are present between the pairs of clamping discs 9, to a clamping position in which the pairs of clamping discs 9 are clamped against each other near their edges. In operation, the epilation head 7 is displaced over the skin in a displacement direction X indicated in FIG. 1 and FIG. 2, said epilation head 7 contacting the skin on a side 11 of the rotating clamping discs 9. During moving the epilation head 7 over the skin, hairs present on the skin penetrate said hair catching spaces, after which these hairs are clamped between the clamping discs 9 as a result of tilting of said clamping discs 9 into the clamping positions, and subsequently said hairs are extracted from the skin under the influence of the rotating movement of the clamping discs 9.

The hair removing device 1 further comprises an auxiliary member for generating a change in temperature of the skin which, in operation, is situated near the epilation head 7. In accordance with the invention, the auxiliary member is a heating member 13 by means of which, in operation, an increase of the temperature of the skin present near the epilation head 7 is generated. In the first example shown in FIG. 1 and FIG. 2, the heating member 13 is provided with a holder 15 having a chamber 17 which is substantially entirely filled with a compound having a eutectic composition, which compound will be described in more detail hereinafter. It is to be noted that, for the sake of clarity, FIG. 2 shows the room 17 in an empty state. The heating member 13 is further provided with a metal skin contact element 19 which, viewed in the displacement direction X, is arranged directly in front of the epilation head 7, and which is in contact with the skin, as is the first side 11 of the rotating clamping discs 9, when the epilation head 7 is moved over the skin. In the chamber 17 extends a plate-shaped, metal heat conducting element 21 which is attached to the skin contact element 19 by means of a flange 23, and via which the skin contact element 19 is in thermal contact with the compound contained in the chamber 17. As FIG. 2 further shows, a coupling member 25 is provided on the holder 15 of the heating member 13, via which coupling member the heating member 13 is detachably coupled to the main housing 5. In the example shown, the coupling member 25 is a projection forming a snap connection in conjunction with a cavity 27 provided in the main housing 3.

In the example shown, the compound comprises $CH_3COONa{\cdot}3H_2O$. This is a crystalline mixture of sodium acetate and water mixed in a eutectic ratio, as a result of which the compound crystallizes from the liquid phase to the solid phase at a substantially constant temperature, the so-termed eutectic temperature, which is approximately 58° C. for this compound. Before using the hair removing device 1, said compound must be converted to the liquid phase by heating to a temperature above the eutectic temperature. To achieve this, the heating member 13 is uncoupled from the main housing 3 and, separate from the hair removing device 3, heated for some time in, for example, hot water or an electrical heating appliance. After heating the heating member 13, said heating member 13 is coupled to the main housing 3 by means of the coupling member 25. As a result, the compound in the liquid phase cools down. Upon reaching the eutectic temperature, the compound crystallizes from the liquid phase to the solid phase. This takes some time as a result of the latent thermal capacity of the compound, so that the skin contact element 19, which is in thermal contact with the compound, is kept at a substantially constant temperature for some time, which temperature is slightly below the eutectic temperature of the compound. The compound used in this example, i.e. $CH_3COONa{\cdot}3H_2O$, has a comparatively large latent heat capacity, so that crystallization to the solid phase takes a comparatively large amount of time and the substantially constant temperature of the skin contact element 19 is maintained for a comparatively long period of time. As the skin contact element 19, viewed in the displacement direction X, is arranged directly in front of the epilation head 7, each skin part is heated through contact with the skin contact element 19 before being treated by the epilation head 7. As a result, the heat receptors present in the relevant skin part generate heat stimuli which are passed on via the nervous system. Immediately after heating a skin part, the hairs present on the relevant skin part are extracted by the epilation head 7. In this process, the pain receptors present in the relevant skin part generate pain stimuli which are normally experienced as very unpleasant by the user. However, as the above-mentioned heat stimuli are present already in the nervous system, the nervous system is partly blocked to the pain stimuli, as a result of which the pain stimuli can be passed on only partly by the nervous system. Thus, the pain stimuli are masked by the heat stimuli and, as a result of this masking effect, the user experiences substantially less pain when the hairs are being extracted. It has been found that this masking effect is comparatively substantial if the temperature of the skin around the heat receptors, i.e. at approximately 0.1 mm below the surface of the skin, lies in the range between approximately 40° C. and 47° C., the masking effect being maximal at a temperature of approximately 45° C. At such temperatures the user experiences comparatively little pain. As shown in FIG. 1 and FIG. 2, the skin contact element 19 has a comparatively large surface area. This results in a comparatively substantial heat transfer from the heating member 13 to the skin, as a result of which the skin is heated, at a temperature of the skin contact element 19 slightly below the eutectic temperature of 58° C. and at customary rates of displacement of the epilation head 7 over the skin, to a temperature in the desired range between approximately 40° C. and 47° C. and an optimum masking effect is obtained. As crystallization of the compound to the solid phase takes a comparatively large amount of time and hence the eutectic temperature is maintained for a comparatively long period of time, the desired optimum masking effect is provided for a comparatively long period of time. The associated temperature of the skin contact element 19 generally is not experienced as unpleasant by the user if the contact with the skin contact element 19 is of short duration. The structure of the heating member 13 is simple and as the heating member 13 can be uncoupled from the main housing 3, it can be used in a practical manner. By using said compound, electric energy does not have to be supplied to the heating member 13 during operation.

A suitable alternative to the compound $CH_3COONa \cdot 3H_2O$ used in this example is $NaOH \cdot H_2O$. This is a crystalline mixture of sodium hydroxide and water, mixed in a eutectic ratio and having a eutectic temperature of approximately 61° C. This alternative compound also has a comparatively large latent thermal capacity, so that when use is made of this alternative compound, the action of the heating member 13 is comparable to that of a heating member that employs $CH_3COONa \cdot 3H_2O$.

FIG. 3 diagrammatically shows a second embodiment of a hair removing device 1' in accordance with the invention, the main difference between said second embodiment and the above-described first embodiment being that the hair removing device 1' is provided with a different type of heating member 13'. The hair removing member 3' of the hair removing device 1' substantially corresponds to the hair removing member 3 of the hair removing device 1, and parts of the hair removing member 3' which correspond to parts of the hair removing member 3 are indicated by means of corresponding reference numerals in FIG. 3. The heating member 13' comprises a heat contact element 19' which is in thermal contact with a controllable electrical resistor 29. In operation, the resistor 29 is fed by an electric current source 31, which can be switched by means of a switch 33. The resistor 29 is controllable by means of an electrical control member 35, which receives an electrical input signal $U_T$ from a temperature sensor 37 provided in the skin contact element 19'. The control member 35 controls the resistor 29 in such a manner that the skin contact element 19' is kept at a predetermined, substantially constant temperature, preferably a temperature in the range between approximately 55° C. and 85° C. Such a temperature of the skin contact element 19' generally is not experienced as unpleasant by users if the contact with the skin contact element 19' is of short duration. If the surface of the skin contact element 19' is sufficiently large and the epilation head 7' is moved over the skin at customary displacement rates, then, at such a temperature of the skin contact element 19', the skin is heated to a temperature in the desired range between approximately 40° C. and 47° C., so that an optimum masking effect is obtained. In the example shown, the temperature is maintained in the range between approximately 77° C. and 83° C., so that the hair removing device 1' can be moved comparatively rapidly over the skin. In addition, a comparatively small surface area of the skin contact element 19' is sufficient, as a result of which the dimensions of the heating member 13' are limited. In this embodiment, the heating member 13' is embodied so as to be comparatively inexpensive and operates in a reliable manner. The desired masking effect is continuously provided, in operation, by the heating member 13'. In the example shown, the heating member 13' is rigidly secured to the main housing 5'. In an alternative embodiment, the heating member 13' is detachably secured to the main housing 5', so that the heating member 13' can be uncoupled from the main housing 5', for example, if the user does not want to make use of the masking effect or if the hair removing member 3' and the heating member 13' must be stored in a storage holder. In the example shown in FIG. 3, the heating member 13' comprises a separate current source 31. The heating member 13' may alternatively be provided with a connection enabling it to be connected to the power supply of the hair removing member 3'.

FIG. 4 diagrammatically shows a third embodiment of a hair removing device 1" in accordance with the invention, the main difference between said third embodiment and the above-discussed first embodiment and second embodiment being that the hair removing device 1" is provided with a further type of heating member 13". The hair removing member 3" of the hair removing device 1" substantially corresponds to the hair removing member 3 of the hair removing device 1, and parts of the hair removing member 3" that correspond to parts of the hair removing member 3 are indicated by means of corresponding reference numerals in FIG. 4. The heating member 13" comprises a source 39 of infrared light, in the example shown a coiled filament that is fed by an electric current source 41 and can be switched by means of a switch 43 and is arranged in front of a reflector 45. In this embodiment, the source 39 is situated, in operation, at some distance from the skin. By using the infrared light source 39, the skin is heated, in operation, in a very effective manner, causing the temperature of the skin to be increased to the desired value in the range between 40° C. and 47° C. in a very short period of time. In this embodiment, the heating member 13" is additionally embodied so as to be very inexpensive. Instead of the filament coil used in the example shown, use can also be made of a different type of infrared light source, such as a halogen lamp.

It is to be noted that the invention also includes hair removing devices comprising a type of hair removing member other than the above-described hair removing members 3, 3', 3", which are each provided with a series of rotatable clamping discs. Such other types of hair removing members are, for example, hair removing members by means of which hairs can be mechanically extracted from the skin, such as a hair removing member having a series of rotatable and axially displaceable clamping discs or a hair removing member with a rotatable, curved, spiral-shaped spring, or hair removing members by means of which hairs are removed from the skin in a non-mechanical way, such as a hair removing member comprising a laser source for removing hairs by means of a laser beam, or a hair removing member comprising a flashlight for removing hairs by means of a light flash of high light intensity.

It is further noted that the invention does not only comprise hair removing devices wherein, viewed in the displacement direction X, the heating member only heats the skin that is situated directly in front of the hair removing member, as in the embodiments described hereinabove. The invention, for example, also includes embodiments wherein the heating member heats the skin at the location of the hair removing member or around the hair removing member. The masking effect is optimal, however, if immediately after the skin has been heated, it is subjected to a treatment by the hair removing member.

What is claimed is:

1. A hair removing device comprising:

a hair removing member for removing hairs from skin; and an auxiliary member for generating a change in temperature of the skin present, in operation, near the hair removing member, wherein the auxiliary member includes a heating member for generating an increase in temperature of the skin present, in operation, near the hair removing member, and wherein the heating member includes a holder for holding a compound and a skin contact element in thermal contact with said compound.

2. A hair removing device as claimed in claim 1, wherein compound has a eutectic composition.

3. A hair removing device as claimed in claim 2, wherein the compound comprises $CH_3COONa \cdot 3H_2O$ or $NaOH \cdot H_2O$.

4. A hair removing device as claimed in claim 2, wherein the heating member comprises a coupling member by means of which the heating member is detachably coupled to a housing of the hair removing device.

5. A hair removing device as claimed in claim 1, wherein the heating member is provided with a controllable electric resistor, a skin contact element that is in thermal contact with the resistor, and a control member for controlling the temperature of the skin contact element.

6. A hair removing device as claimed in claim 5, wherein, in operation, the control member causes the skin contact element to be at a substantially constant temperature in the range between approximately 55° C. and 85° C.

7. A hair removing device as claimed in claim 6, wherein the temperature of the skin contact element ranges, in operation, between approximately 77° C. and 83° C.

8. A hair removing device as claimed in claim 6, wherein the beating member comprises a source of infrared light.

9. A method for removing hair from skin comprising the acts of:

providing a hair removing device including a main housing and an auxiliary member having a chamber for storing a compound;

I) prior to using said hair removing device:

a) decoupling said auxiliary member from said main housing; and b) heating said decoupled auxiliary member to an elevated temperature causing said compound to change from a solid phase to a liquid phase;

II) upon using said hair removing device:

c) re-coupling said auxiliary member to said main housing thereby causing said compound to transition back to said solid phase from said liquid phase as it cools;

d) thermally contacting said compound with a metal skin contact element of the hair removing device, wherein the temperature of sand metal skin contact is maintained substantially at an temperature slightly below a temperature corresponding to said phase change from said liquid phase back to said solid phase; and e) contacting said metal skin contact element with the skin as said hair removing device is moved across the skin thereby causing a rise in skin temperature upon contact.

10. The method of claim 9, wherein said auxiliary member is a heating member.

11. The method of claim 10, further comprising the act of controlling the temperature of the skin contact element via control means provided in said heating member.

12. The method of claim 11, wherein said control means causes the skin contact element to be at a substantially constant temperature in the range between approximately 55°C. and 85° C.

13. The method of claim 9, wherein said compound is a eutectic composition.

14. The method of claim 9, wherein said phase change from a solid phase to a liquid phase and said phase change from a liquid phase to a solid phase occur substantially at eutectic temperature of said compound.

15. The method of claim 9, wherein the compound comprises $CH_3COONa \cdot 3H_2O$ or $NaOH \cdot H_2O$.

* * * * *